US011883736B2

(12) United States Patent
Schmidinger

(10) Patent No.: US 11,883,736 B2
(45) Date of Patent: Jan. 30, 2024

(54) DEVICE AND METHOD OF MANUFACTURING FOR A SNOW AND WATER SPORT SLIDING DEVICE WITH A PNEUMATIC CORE

(71) Applicant: The Moss Companies, Sugar Mountain, NC (US)

(72) Inventor: Krista Schmidinger, Sugar Mountain, NC (US)

(73) Assignee: The Moss Companies, Sugar Mountain, NC (US)

( * ) Notice: Subject to any disclaimer, the term of this patent is extended or adjusted under 35 U.S.C. 154(b) by 0 days.

(21) Appl. No.: 17/982,042

(22) Filed: Nov. 7, 2022

(65) Prior Publication Data

US 2023/0241488 A1 Aug. 3, 2023

Related U.S. Application Data

(60) Provisional application No. 63/304,839, filed on Jan. 31, 2022.

(51) Int. Cl.
*A63C 5/12* (2006.01)
*A63C 5/048* (2006.01)

(52) U.S. Cl.
CPC ..... *A63C 5/12* (2013.01); *A63C 5/048* (2013.01)

(58) Field of Classification Search
CPC ..... A63C 5/12; A63C 5/048
See application file for complete search history.

(56) References Cited

U.S. PATENT DOCUMENTS 2,756,517 A * 7/1956 Youtz ..... A63B 25/10 36/7.8
3,031,695 A * 5/1962 Kunkel ..... B63B 32/30 441/70
3,603,606 A * 9/1971 Eie ..... A63C 9/18 280/615
3,635,482 A * 1/1972 Holman ..... A63C 5/048 280/610
3,845,967 A * 11/1974 O'Brien ..... B62B 19/04 180/185
5,803,479 A * 9/1998 Meyer ..... A63C 5/075 280/607
7,344,149 B2 * 3/2008 Leitner ..... A63C 5/003 280/607
9,180,358 B2 * 11/2015 Heil ..... A63C 5/0405
10,577,519 B2 * 3/2020 Prince ..... C09G 3/00

FOREIGN PATENT DOCUMENTS

DE 202004001356 U1 * 5/2005 ..... A63C 5/003
KR 20050067638 A * 7/2005
WO WO-9428984 A1 * 12/1994 ..... A63C 5/12

* cited by examiner

*Primary Examiner* — James A Shriver, II
*Assistant Examiner* — Michael T. Walsh
(74) *Attorney, Agent, or Firm* — CALDWELL INTELLECTUAL PROPERTY LAW

(57) ABSTRACT

A snow and water sport sliding device with a pneumatic core and method of manufacturing the device. The device includes a top layer comprising a front tip, a middle segment with a binding plate, and a back segment with an adjustable air valve. Top layer may also include a blade spring system. The device also includes a main core component layer under the top layer that comprises of a hollow air chamber, and a base layer. Base layer may include embedded metal edge.

16 Claims, 9 Drawing Sheets

DEVICE AND METHOD OF MANUFACTURING FOR A SNOW AND WATER SPORT SLIDING DEVICE WITH A PNEUMATIC CORE

CROSS-REFERENCE TO RELATED APPLICATIONS

This application claims the benefit of priority of U.S. Provisional Patent Application Ser. No. 63/304,839, filed on Jan. 31, 2022, and titled "SYSTEM AND METHOD OF MANUFACTURING FOR A SNOW AND WATER SPORT SLIDING DEVICE WITH A PNEUMATIC CORE," which is incorporated by reference herein in its entirety.

FIELD OF THE INVENTION

The present invention generally relates to the field of snow sliding devices. In particular, the present invention is directed to a device and method of manufacturing for a snow and water sport sliding device with a pneumatic core.

BACKGROUND

The evolution of ski fabrication has attempted to address the two major drivers of performance; linking carved single consecutive turns or arcs on the snow without skidding or stick slip and dampening vibration of the ski as it moves down and across the fall line as it relates to a slope over the snow. Conventional ski manufacturing utilizes a sandwich construction method. Multiple layers of materials known in the art such as: laminated woods, synthetics and metals are bonded together under pressure with epoxy resins to make up the properties of the ski. Today's traditional ski, or snow sliding device, is like riding a bike on wooden wheels since there is very little ability to corner, no shock absorption, and a high probability of injury. The present invention is configured to change and improve handling (e.g. shock absorption), turn efficiency (e.g., cornering), and to protect the health and safety of the user.

SUMMARY OF THE DISCLOSURE

In an aspect, a snow sliding device, wherein the device includes a top layer, the top layer including a front tip, a middle segment connected to the front tip, wherein the middle segment includes a binding plate, and a back segment connected to the middle segment, wherein the back segment includes an adjustable air valve. The device further including a main core component layer located beneath the top layer, wherein the main core component layer comprises a hollow air chamber. The device further including a base layer.

In another aspect, a method of manufacturing a snow sliding device, the method of manufacturing including providing a top layer, wherein the top layer comprises a front tip, a middle segment, and a back segment. The method further including fastening a binding plate to the middle segment of the top layer. The method further including embedding an adjustable air valve into a back segment of a top layer. The method further including latching linear concave sidewalls surrounding the top layer using a tubeless bead to create a hollow air chamber. The method further including molding a base layer to the linear concave sidewalls.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

At a high level, aspects of the present disclosure are directed to a hollow snow and water sport sliding device. In an embodiment, snow and water sport sliding device includes a top layer which includes a front convex top, a middle segment, and a back segment. Aspects of the present disclosure include a middle segment which may include a binding plate. Aspects of the present disclosure include a back segment having an adjustable air valve. Aspects of the present disclosure also include a main core component layer including a concave hollow air chamber. Aspects of the present disclosure include a base layer.

Aspects of the present disclosure may be used in a design for a snow and water-sport device. Some examples of snow and water-sport devices may include all forms of ski mobility i.e., snowboards, cross-country skis, ski jumping skis, water-skis, skidoo. Device may be utilized in any kind of ski disciples, such as but without limitation, alpine, mountaineering, freestyle, freeride, speed skiing, telemark, grass skiing, or the like. Device may utilize a pneumatic system by providing suspension. In this disclosure, a "pneumatic system" is a collection of interconnected components using compressed air to do work in a machine or device. A pneumatic system may achieve adequate planar flexure necessary to support a user of device, in conjunction with camber thrust for torsional robustness and cushioning. A balance of stiffness (modulus) and softness (damp vibration before they reach the skier over irregular terrain) may be provided by an interfacing pneumatic system. A linear pneumatic system may be composed of a multi component system. A composite spring blade top layer and a main core component layer may also be included, which may include a hollow air chamber and metal edges embedded into a base layer. The below interrelated attributes and multi-physics pneumatic ski construction method will dramatically change and improve handling, turn efficiency and the health and safety of the enthusiast by reducing shocks and fatigue to the body. The ski experience will be exponentially safer and more enjoyable.

Figure 1A:
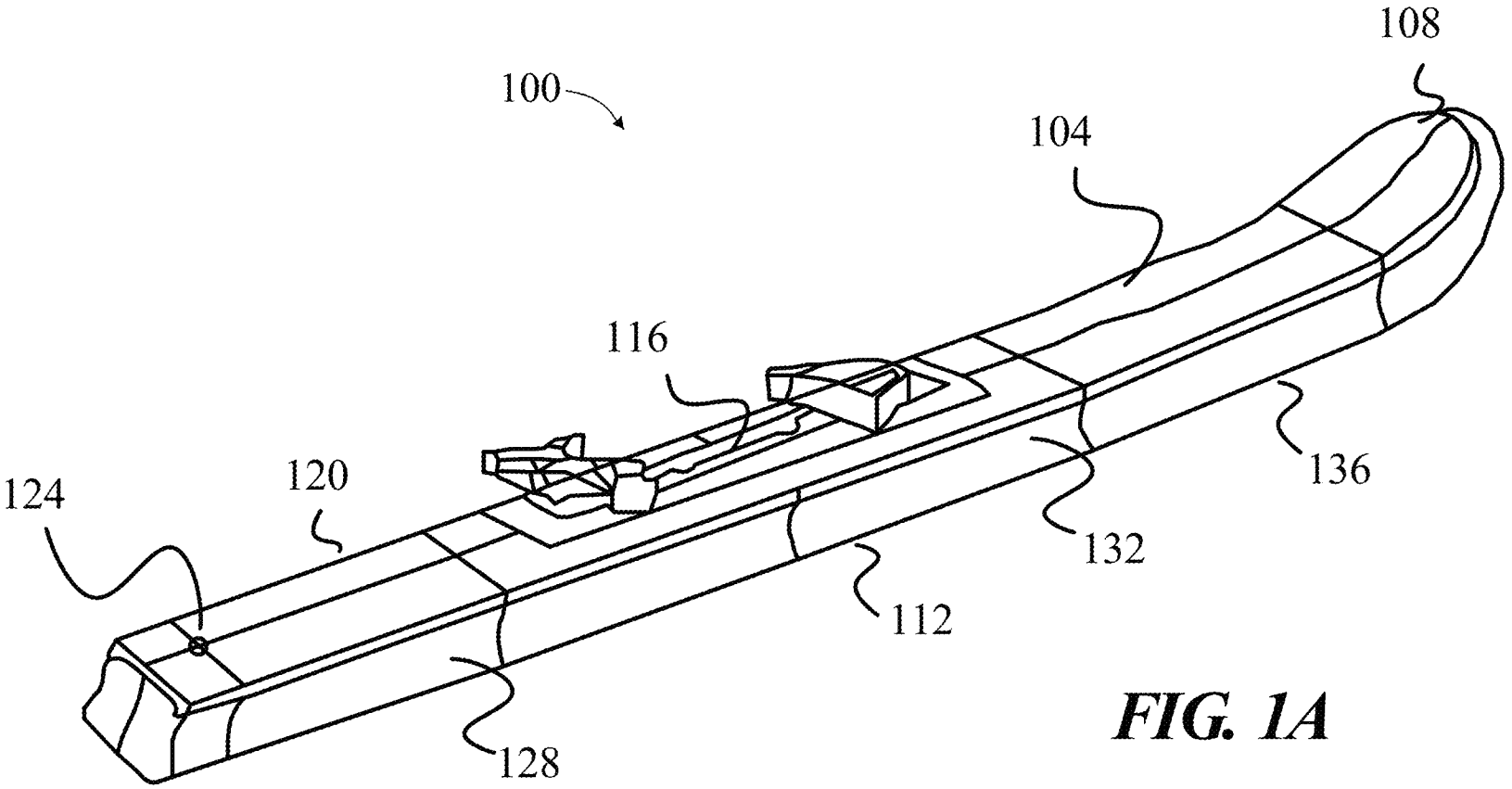
FIG. 1A is an exemplary embodiment of a snow and water sport sliding device with a pneumatic core.

Now referring to FIG. 1A, an exemplary embodiment of a device for a snow and water sport sliding device with a pneumatic core is illustrated as device 100. Snow and water sport sliding device may include a device that is solely a snow sliding device, such as a ski, snowboard, or the like, a device that is solely used for water sports such as a surfboard, wakeboard, and/or paddleboard, and/or a device that can do either. Device 100 includes top layer 104, front tip 108, middle segment 112, binding plate 116, back segment 120, air valve 124, main core component layer 128, air chamber 132, and a base layer 136. All components of the device are interchangeable.

Still referring to FIG. 1A, device 100 includes a top layer 104. In this disclosure, a "top layer" is a topmost part of a snow and water-sport device. Top layer may be composed of composite solutions carbon fiber, fiberglass, and/or any other material or combination of materials with similar properties. Top layer includes a front tip 108, middle segment 112, and back segment 120, which are further explained below. Top layer 104 may include a spring blade system, which may include without limitation a composite spring blade system. In this disclosure, a "spring blade system" is a spring system that absorbs vertical vibrations in order to allow a smoother sliding experience. Spring blade system may be composite, meaning it may be composed of several elements, materials, or objects. Spring blade system may include one or more miniature springs housed in top layer 104. Spring blade system may provide suspension to achieve adequate planar flexure necessary to support a user. A blade spring, or the like, included in and/or including top component may support camber thrust rebound and/or torsion spring properties. In this disclosure, "camber thrust" is a force generated perpendicular to a direction of travel of a tire or, in this case, a sliding device, due to its camber angle and finite contact patch. As pneumatic device leans out of a fall line, camber thrust may be introduced, generating a new source of kinetic power.

Still referring to FIG. 1A, top layer 104 includes a front tip 108. In this disclosure, a "front tip" is a part of a device that is located at a front end of the device. Front tip 108 is convex, where "convex" in this context means it is slightly angled and/or curved upward, for easier air movement for when device is in use. In some embodiments, front tip 108 could be concave depending on the design of the embodiment. Front tip 108 may be made from the same material as top layer. Front tip 108 may be seamlessly attached to top layer 104; top layer 104 may be substantially flat. An opposing end of device may be similarly convex or concave to front tip 108. Convexity at front tip 108 and back tail may allow, in some embodiments, for higher tolerances of pneumatic changes at the tip and tail.

Still referring to FIG. 1A, top layer 104 further includes a middle segment 112. In this disclosure, a "middle segment" is an area of a top layer located in the middle of a device and/or between a front tip 108 and back segment 120. Middle segment 120 may be made from any material suitable for construction of top layer 104. Middle segment 120 may include an area of device that supports a majority of a user's body weight. Middle segment 112 includes a binding plate 116. In this disclosure, a "binding plate" is a component of snow and water sport sliding device that is used to secure a user and/or footwear of the user to the device. Binding plate 116 may include and/or be connected to a binding, which is further explained below with reference to FIG. 3. Binding may be a part of binding plate 116 and/or a component attached thereto that attaches to a user or an element of footwear worn by the user. Binding plate 116 may include an aluminum layer, or other layer of suitable material such as a metal or wooden layer or a layer constructed of high-density polyvinyl chloride; aluminum layer may act to ease a process of attaching binding plate 116 to top layer 104. Aluminum layer may help binding plate 116 be more secure and safe for a user to use.

Still referring to FIG. 1A, top layer 104 may include a back segment 120. In this disclosure, a "back segment" is a part of top layer 104 that is furthest back in device and is located behind middle segment on an opposing end from front tip 108. Back segment 120 may include a back tail which may be convex or concave, similarly to front tip 108; in an embodiment this may help with air movement. For the purposes of this disclosure, a "back tail" is a rear portion of a top layer that has increased curvature relative to the middle segment of a top layer. Back segment 120 also includes an adjustable air valve 124; air valve may alternatively or additionally be included on any other part of device. In this disclosure, an "air valve", also known as a pneumatic valve, is a device for controlling the flow of air in and out of something, which in this disclosure is the hollow air chamber. Air valve may be "adjustable" because a user may adjust the valve to open, which releases the pressurized air from inside the air chamber, or to close, which ceases the flow of air out of the air chamber. Adjustable air valve may have an open position and/or a closed position. Adjustable air valve 124, when in the open position, may be configured to allow air to pass in and out of hollow air chamber through a port. Adjustable air valve 124, when in the closed position may be configured to not allow air to pass in and out of hollow air chamber through the port. As air pressure is increased, compressed air may start to push against the walls of the device which may cause valve to actuate. Whether air valve 124 opens or closes may depend on the user adjusting the port to be open or closed. This can be done by twisting the valve, or any other user action needed to open or cover the port/opening. When open, air is released and the pressure of the air inside the hollow air chamber decreases; when closed, air is contained within the air chamber and the pressure stays the same. Air valve 124 may increase the pressure inside the hollow air chamber by pumping air into it using CO2 cartridges or an air pump. Adjustable air valve 124 may be designed for CO2 cartridges. Adjustable air valve 124 may also be designed for an air pump. Adjustable air valve 124 may include an air gauge. An "air gauge," as used in this disclosure, is a device that displays air pressure values to a user; an air gauge may include without limitation a rotary actuator in an analog display gauge that allows an indicator to rotate a full 360 degrees. Air gauge may display air pressure inside device to a user. Air gauge may include a measuring device that uses air nozzles to sense a surface to be measured. Using this technique, air may be passed to one or more sensing nozzles and a resulting flow may be measured by an air gage readout that may be calibrated to display in linear dimensions.

With continued reference to FIG. 1A, in some embodiments, adjustable air valve 124 may include an air valve that is compatible with a bike valve. Bike valves, as non-limiting examples, may include SHRADER valves, PRESTA valves, and the like.

Referring still to FIG. 1A, device 100 further includes a main core component layer 128. In this disclosure, a "main core component layer" is a middle part of device located between top layer 104 and base layer. Main core component layer 128 is hollow inside and may include linear concave sidewalls. "Concave," as used in this context, means that when pressure is applied to top layer of device, walls will bend inward. Linear concave sidewalls also may have a flat, smooth surface or could also have an accordion-like shape. Linear concave sidewalls may be walls encapsulating air core of the device. Linear concave sidewalls may be made from synthetic or natural rubber, silicone, or any similarly flexible materials; materials may be airtight. Linear concave sidewalls may be thinner than the rubber at base layer to allow for better stability, or thicker. An effect of linear concave walls may be to avoid permitting a portion of device and/or a boot or other footwear of a user from bottoming out and cutting or otherwise damaging sidewalls of hollow air chamber. A combination of air and rubber in conjunction with the user's push down the fall line may provide sufficient elasticity and/or viscosity to conform to irregularities in terrain, thus maximizing surface contact and friction on demand. Linear concave sidewalls may be attached to top layer 104 by a glue adhesive, bolts, welding, wire bead latching, or the like. In some embodiments, the rubber may be chosen, using, for example, the considerations outlined below, to withstand freezing and/or fluctuating winter temperatures. In some embodiments, rubber may include UHMW Polyethylene (P-TEX).

With continued reference to FIG. 1A, rubber may include synthetic rubbers. For the purposes of this disclosure, "synthetic rubber" is a rubber that has been produced from petroleum or petroleum-derived compounds. As a non-limiting example, synthetic rubber may include ethylene propylene diene monomer (EPDM). This may be a good choice for any product that requires general ozone, chemical and/or weather resistance. EPDM has good resistance to alcohols, greases, detergents, ketones, silicone oils, and/or mild acids. EPDM may be a cost-effective material. As another non-limiting example, synthetic rubber may include Styrene Butadiene (SBR). SBR may have many of the same properties as natural rubber, but is petroleum-based rather than latex-based. SBR rubber may have good abrasion characteristics and reasonably good tear and elongation properties SBR may be resistant to abrasion, tears, electricity, cracks, non-petroleum-based fluids, odors and/or, to an extent, heat. SBR may also have a low compression set. SBR rubber has disadvantages similar to natural rubber. Both can demonstrate poor oil and ozone resistance. SBR rubber also may have low tensile strength. As another non-limiting example, synthetic rubber may include neoprene and/or chloroprene rubber. Neoprene rubber may be produced by polymerizing Chloroprene. Neoprene may be the ideal choice for any product that requires petroleum oils and weather resistance. Unlike other rubber materials that do one or the other, Neoprene rubber performs well when exposed to petroleum products but also includes resistance to ozone, UV, and oxygen. Neoprene may also be easy to bond to a variety of substrates. Neoprene rubber may be resistant to more elements than other rubber types, but it cannot withstand everything. Neoprene's main disadvantages are that it is not resistant to solvents and has only moderate water resistance. As another non-limiting example, synthetic rubber may include nitrile rubber. Nitrile rubber may be referred to as nitrile butadiene rubber, NBR, Buna-N and acrylonitrile butadiene rubber. Nitrile rubber may be a good choice for a product that requires petroleum (oil or gas) resistance. One of nitrile rubber's biggest advantage is its resistance to petroleum, but it also has several other desirable properties. It may also have excellent abrasion resistance, good tear resistance and a low compression set. However, Nitrile rubber may not be ideal in applications that require prolonged exposure to ozone or heat. It is not resistant to these elements or flames and may only have a moderate operating temperature range. As a non-limiting example, synthetic rubber may include Butyl rubber. Butyl rubber is a synthetic rubber that may be valued for its low gas and moisture permeability and vibration dampening. Molded butyl rubber also has good resistance to heat aging, abrasion and tearing, and can be a good electrical insulator. One advantage of butyl rubber may be its excellent gas and moisture permeability. It may have excellent vibration dampening and resistance to heat, UV and ozone. It also may have chemical inertness, meaning it is not reactive when combined with other materials. A disadvantage of butyl rubber may be its cost. The sometimes a similar, less expensive, easier to work rubber material can be used in its place. Butyl rubber may also difficult to process. In terms of performance, Butyl may only have a modest working temperature range. Butyl rubber demonstrates poor resistance to petroleum. As another non-limiting example, synthetic rubber may include fluoroelastomer rubber. In some cases, fluoroelastomer rubber may be referred to as VITON rubber. Fluoroelastomer rubber may be the ideal choice for any product that experiences extremes in either temperature or fluid exposure. Fluoroelastomer rubber is a high performance rubber specifically formulated to withstand these extremes. Fluoroelastomers generally have low gas permeability. Typical applications of fluoroelastomer rubber may include O-rings, seals and gaskets that must withstand aggressive temperature or chemical exposure. Fluoroelastomer rubbers may stand up to temperatures up to 480° F. Fluoroelastomer rubbers may have great resistance to temperature and most chemicals as well as UV and ozone. Fluoroelastomer rubbers may have a higher cost than many other rubber materials. Disadvantages for fluoroelastomer rubbers may also include poor resistance to hot water and steam and a fairly low temperature flexibility. As another non-limiting example, in some embodiments, synthetic rubber may include ultra-high-molecular-weight polyethylene (UHMWPE).

With continued reference to FIG. 1A, in some embodiments, rubber may include silicone rubber. For the purposes of this disclosure, "silicone rubber" is a rubber containing silicone. Silicone rubber may be used as a sealant. Silicone rubber may be preferred in situations where it may be exposed to extreme temperatures. Silicone rubber may have a good compression set. Silicone rubber may provide desirable chemical and/or weather resistance. Hover, silicone rubber may have poor abrasion resistance. Silicone rubber may also have poor tear resistance. Silicone rubber tend to be more costly than other types of rubber. As non-limiting examples, silicone rubber may include Fluorosilicone, High Consistency Rubber Silicone (HCR) and/or Room Temperature Vulcanizing (RTV) silicone.

With continued reference to FIG. 1A, in some embodiments, rubber may include natural rubber. For the purposes of this disclosure, "natural rubber" is a rubber substance found in nature. In some embodiments, natural rubber may undergo additional processing or purification after it has been obtained from nature. Natural rubber may exhibit good tear and/or abrasion resistance. Natural rubber may have low compression set values. Natural rubber may display desirable vibration damping characteristics. Natural rubber may have high tensile strength. Natural rubber may bond to a variety of substrate. However, natural rubber may exhibit poor UV and/or ozone resistance. Natural rubber may have poor resilience when exposed to petroleum oil. Natural rubber may also have poor heat resistance.

With continued reference to FIG. 1A, in some embodiments, device 100, or various components of device 100 may include a mixture of one or more of the rubbers disclosed in this application. As a non-limiting example, one portion of device 100 may include a natural rubber, whereas another portion of device 100 may include a synthetic rubber. A person of ordinary skill in the art, after having reviewed the entirety of this disclosure, would appreciate that a variety of rubber compounds may be chosen for various components of device 100 according to the needs of those components and the properties of the rubber compounds chosen.

Still referring to FIG. 1A, main core component layer 128 includes a hollow air chamber 132. An "air chamber", in this disclosure, is a pocket of air and/or other gas located inside main core component layer 128 of the device and is encapsulated by the linear concave sidewalls. Hollow air chamber 132 may be concave due to a concavity of linear sidewalls surrounding it. Hollow air chamber 132 may be surrounded by linear concave sidewalls, top layer 104 on the top, and base layer 136 below. Hollow air chamber 132 may be pressurized. Hollow air chamber 132 may be manually pressurized. A "manually pressurized" chamber, as used in this disclosure, is a chamber in which a user controls pressure inside hollow air chamber 132 by the use of air valve 124. A chamber is "pressurized," for the purposes of this disclosure, if it holds an internal gas or air at a level of pressure higher than a pressure of the chamber's exterior environment, such as without limitation atmospheric pressure where device is located. Hollow air chamber 132 may act as a spring, such as a gas spring, and/or may allow linear concave sidewalls to act as a spring. Hollow air chamber 132 is a cavity containing air to act by its elasticity as a spring for equalizing flow of sliding device across a surface.

Referring still to FIG. 1A, device 100 further includes a base layer 136. In this disclosure, a "base layer" is a bottommost component of a device and is a component that is in contact with snow or water over which the device is configured to slide. Base layer 136 may be composed at least in part, or in other words wholly or in part, of hydrophobic material, where a "hydrophobic material" is a material, such as a non-polar material, with a low affinity to water, which makes the material water repelling. Examples of hydrophobic material that base layer 136 may include and/or be composed of at least in part include polyethylene, rubber, or the like. A rubber, treadless base may allow for low coefficient of friction. Base layer may be composed of an elastic material such as rubber, carbon, fiberglass, or the like. Base layer 136 material may also exhibit some degree of elastic deformation in response to loads attendant to use of device. Base layer 136 may include embedded metal edges for friction on demand. Metal edges are further described herein with reference to FIG. 3. Metal edges may be a straight edge, sawtooth cuts, a serrated edge, or anything similar. In an embodiment, metal edges may be embedded within base layer 136. Base layer 136 may be composed at least in part of wax absorbent materials.

With continued reference to FIG. 1A, in some embodiments, base layer 136 may include a friction reducing coating. For the purposes of this disclosure, a "friction reducing coating" is a coating that reduces the coefficient of friction between the surface that it is applied to and a secondary surface. In some embodiments, friction reducing coating may include ski wax. Ski wax may include any wax formulated to be applied to the bottom of skis for the purposes of reducing friction. Ski wax may include glide wax. In some embodiments, glide wax may include solid hydrocarbons. In some embodiments, glide wax may include fluorocarbons. A friction reducing coating may aid device 100 in sliding down a slope with reduced friction. In some embodiments, friction reducing coating may be applied only to a portion of base layer 136.

With continued reference to FIG. 1A, in some embodiments, base layer 136 may include a static friction enhancing coating. For the purposes of this disclosure, a "static friction enhancing coating" is a coating that increases reduces the coefficient of static friction between the surface that it is applied to and a secondary surface. Static friction enhancing coating may include a ski wax such as a grip wax. In some embodiments, static friction enhancing coating may be applied only to a portion of base layer 136. As a non-limiting example, static friction enhancing coating may be applied to only the portion of base layer 136 that is underneath the bindings or binding plate 116 of device 100. In some embodiments, static friction enhancing coating may include a hard wax such as a paraffin wax-based substance. In some embodiments, static friction enhancing coating may include klister, which may contain a combination of rosins, waxes, solvents, and fats.

Still referring to FIG. 1A, views of main core component layer 128 and base layer 136 are also shown. Components are shown in exemplary locations as an illustration but may be located anywhere on their respective segments on top layer 104 as explained above. Overall, snow and water sport sliding device may have any three-dimensional and/or cross-sectional form, including a tubular form, a rectangular or trapezoidal shaped cross-section, and/or any combination of polygonal and/or curved cross-sections; cross-sectional form of device may vary over length of device. Device may have a pneumatic carbon fiber structure. Two devices may be used together in some embodiments, such as use of two skis and/or water skis.

Figure 1B:
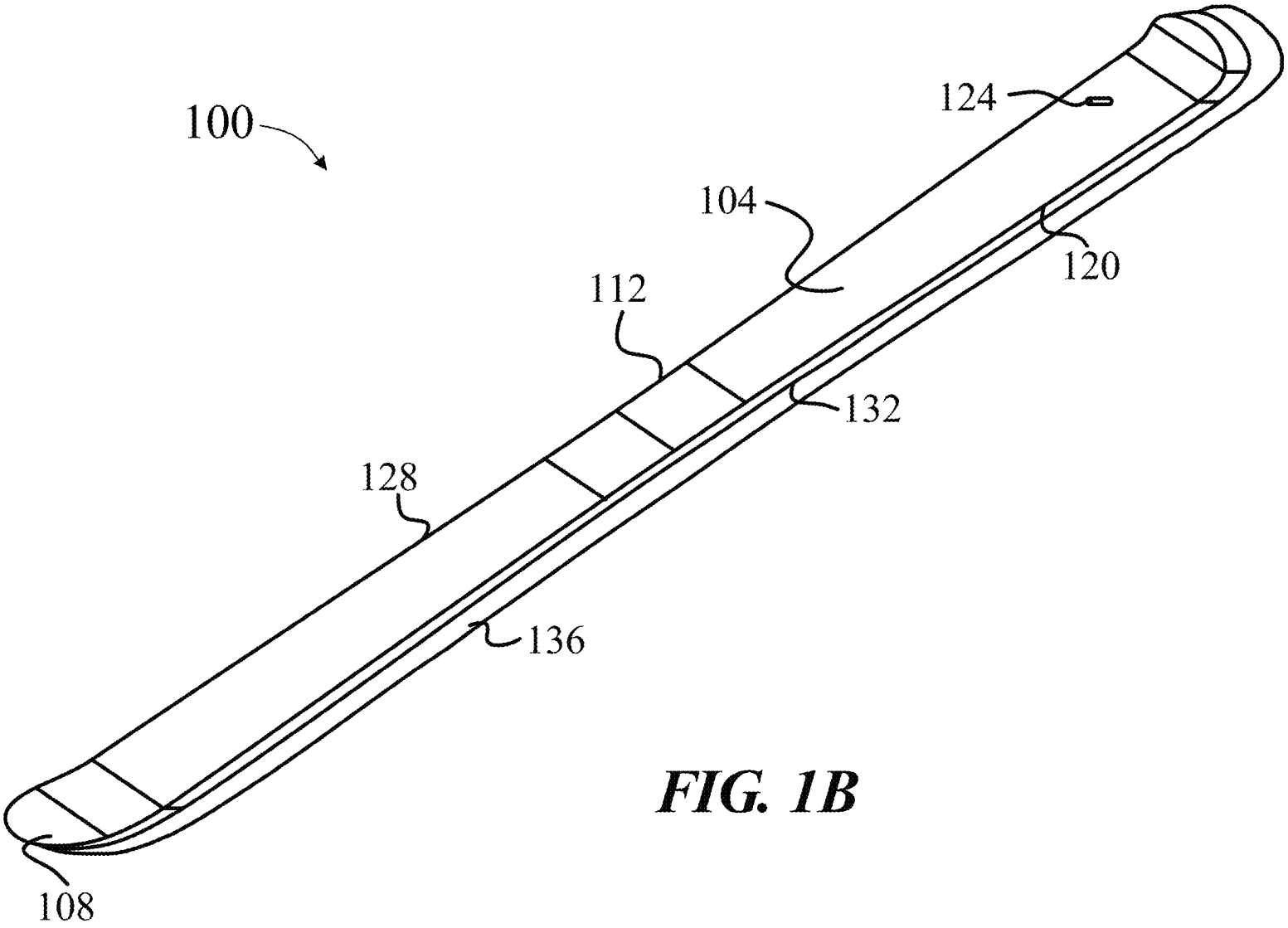
FIG. 1B is another exemplary embodiment of a snow and water sport sliding device with a pneumatic core.

Now referring to FIG. 1B, another exemplary embodiment of a snow and water sport sliding device with a pneumatic core is illustrated. Here, both front tip 108 and back segment 120 are convex. Device 100 includes top layer 104, front tip 108, middle segment 112, back segment 120, air valve 124, main core component layer 128, air chamber 132, and a base layer 136. All components of the device may be interchangeable.

Figure 2:
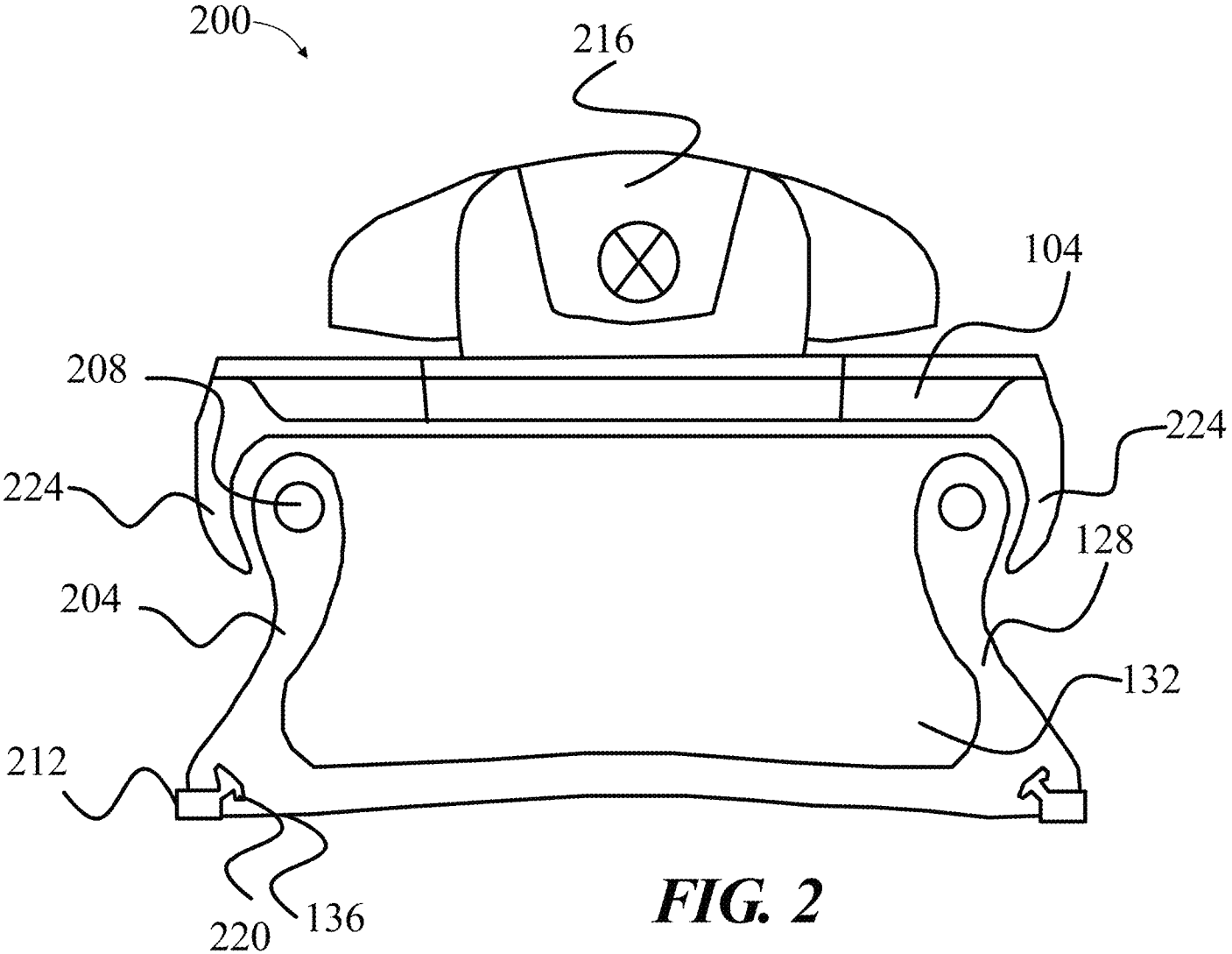
FIG. 2 illustrates a cross-sectional area view of an exemplary embodiment of a snow and water sport sliding device with a pneumatic core.

Now referring to FIG. 2, a cross-sectional area view of an exemplary embodiment 200 of a device 100 for a snow and water sport sliding device with a pneumatic core is illustrated. The figure includes top layer 104, component layer 128, air chamber 132, base layer 136, linear concave sidewall 204, tubeless bead 208, metal edge 212, and binding 216.

Still referring to FIG. 2, in top layer 104, binding plate 116 may be attached on top of top layer 104 of device 100. Binding plate 116 may be sandwiched on to the ceiling of top layer 104. A "binding" is a component of top layer 104 that binds a user to device so the device does not fall off during use. A binding may include a part of a ski device that attaches to another device configured to house a foot of the user, such as, but not limited to, a boot or any other shoe. Binding 216 may be mounted seamlessly to binding plate 116, and thereby to the device, using an aluminum layer or other rigid metallic, wooden or other layer for binding screws and/or fasteners to fasten into. Binding plate 116 may be made of aluminum. Binding 216 may ensure that device 100 stays attached to user so that the user may maneuver device over snow and/or water. Binding 216 may have components used to attach to a boot, such as but without limitation, brakes, an anti-friction device, riser plates, integrated bindings, forward pressure, toe height adjustment, or any other components helpful for comfort and strong fastening to the user.

With continued reference to FIG. 2, bindings may include downhill ski bindings. In some embodiments, bindings may include integrated bindings, wherein the bindings are integrated into device 100 such that they are not removeable from device 100. As non-limiting examples, downhill ski bindings may include alpine bindings, alpine touring bindings, tech (DYNAFIT) bindings, and the like. In some embodiments, bindings may include backcountry bindings. Backcountry bindings may include, as non-limiting examples, randoneé and/or telemark bindings.

With continued reference to FIG. 2, bindings may include cross-country ski bindings. Cross-country ski bindings may include, as non-limiting examples, 75 mm bindings, 3 pin bindings, NORDIC NORM (NN), NEW NORDIC NORM (NNN), SALMON NORDIC SYSTEM (SNS), NORDIC INTEGRATED SYSTEM (NIS), Integrated Fixation Plate, PROLINK, NEW TELEMARK NORM, telemark bindings, and the like.

Referring still to FIG. 2, also pictured are linear concave sidewalls 204 that may be latched into top layer 104 using a tubeless bead 208. In this disclosure, a "tubeless bead" is an edge of linear concave sidewalls 204 that rests on the inside of top layer 104 as shown. Tubeless bead 208 may sit inside of a small slot or groove attached to linear concave sidewalls 204. In some embodiments, tubeless bead 208 sit inside of a grove, slot, depression, or the like created by a rim 224. Rim 224 may be a component of or attached to top layer 104. In some embodiments, tubeless bead 208 may press outwards on rim 224 so as to attach linear concave sidewalls 204 to top layer 104. In some embodiments, rim 224 may include a slot into which tubeless bead 208 may fit. In some embodiments, rim 224 may be curved so as to create an indentation into which tubeless bead 208 may fit. Tubeless bead 208 may have a wire or aramid core. Tubeless bead 208 may prevent material of linear concave sidewalls 204 from jumping off top layer 104. In an embodiment, tubeless bead 208 may expand with pressure from inside hollow air chamber 132. Tubeless bead 208 may also act to seal air within hollow air chamber 132. In some embodiments, embodiment 200 of device 100 may include a key component 220 as disclosed further below.

Figure 3:
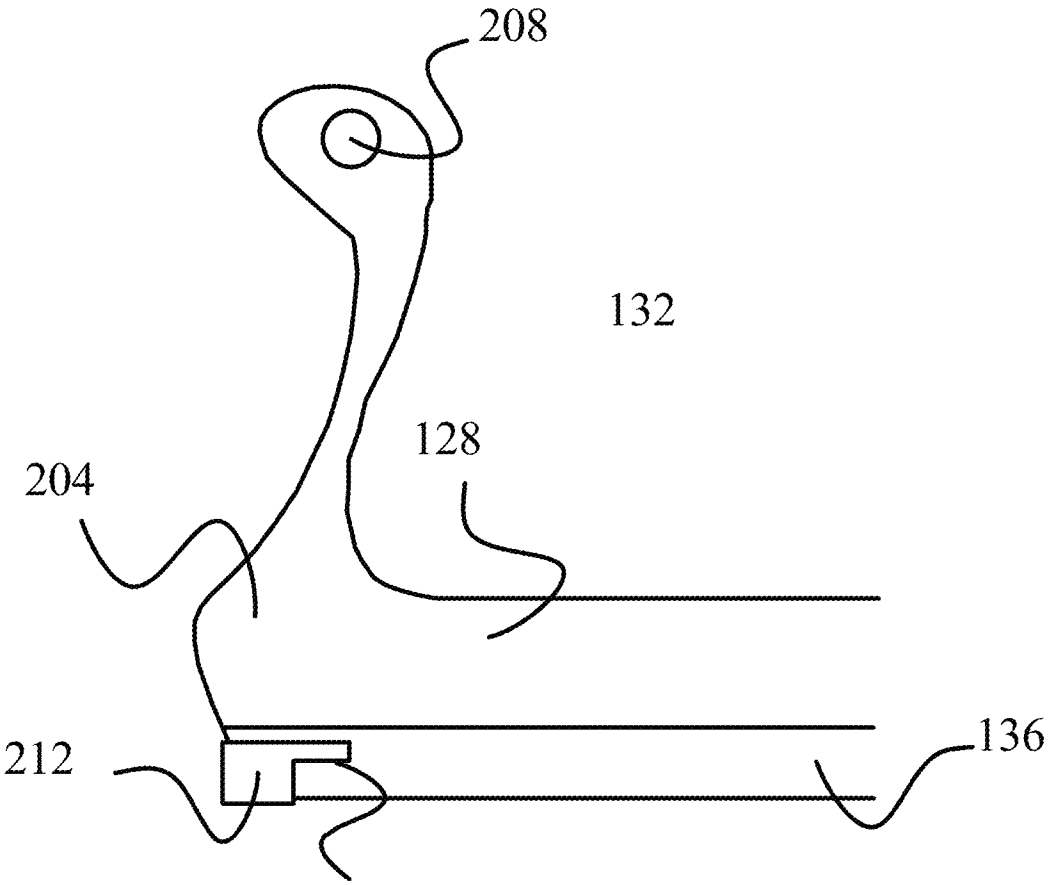
FIG. 3 is a closer look at the cross-sectional area view of an exemplary embodiment of a snow and water sport sliding device with a pneumatic core as shown in FIG. 3.

Now referring to FIG. 3, a closer look at a cross-sectional view of an exemplary embodiment of a snow and water sport sliding device with a pneumatic core as shown in FIG. 2 is illustrated. The figures illustrate exemplary embodiments of a main core component layer 128, air chamber 132, base layer 136, linear concave sidewall 204, tubeless bead 208, and metal edge 212.

With continued reference to FIG. 3, metal edge 212 may be embedded into sides of base layer 136. Metal edge 212, embedded on either side of a base layer 136, may enable friction on demand necessary for carving, braking and accelerating. "Siping" (straight edge, sawtooth cuts or serrated edge) may be applied to metal edges, which may add friction on demand by forcing each metal edge to conform and interlock with undulating snow-covered terrain in ways that enhance carving under hard cornering and/or enhance traction on slick ice or snow. Pairing of metal edge with base layer 136 component may leverage a principle of mechanical keying, enabling latching of the device with undulating terrain and minimizing stick slip, for instance thus allowing consecutive singular arcs. In some embodiments, metal edge 212 may include a key component 220. Key component 220 may allow attachment As a non-limiting example, key component 220 may be a T-shaped component that attached metal edge 212 to base layer 136

Figure 4:
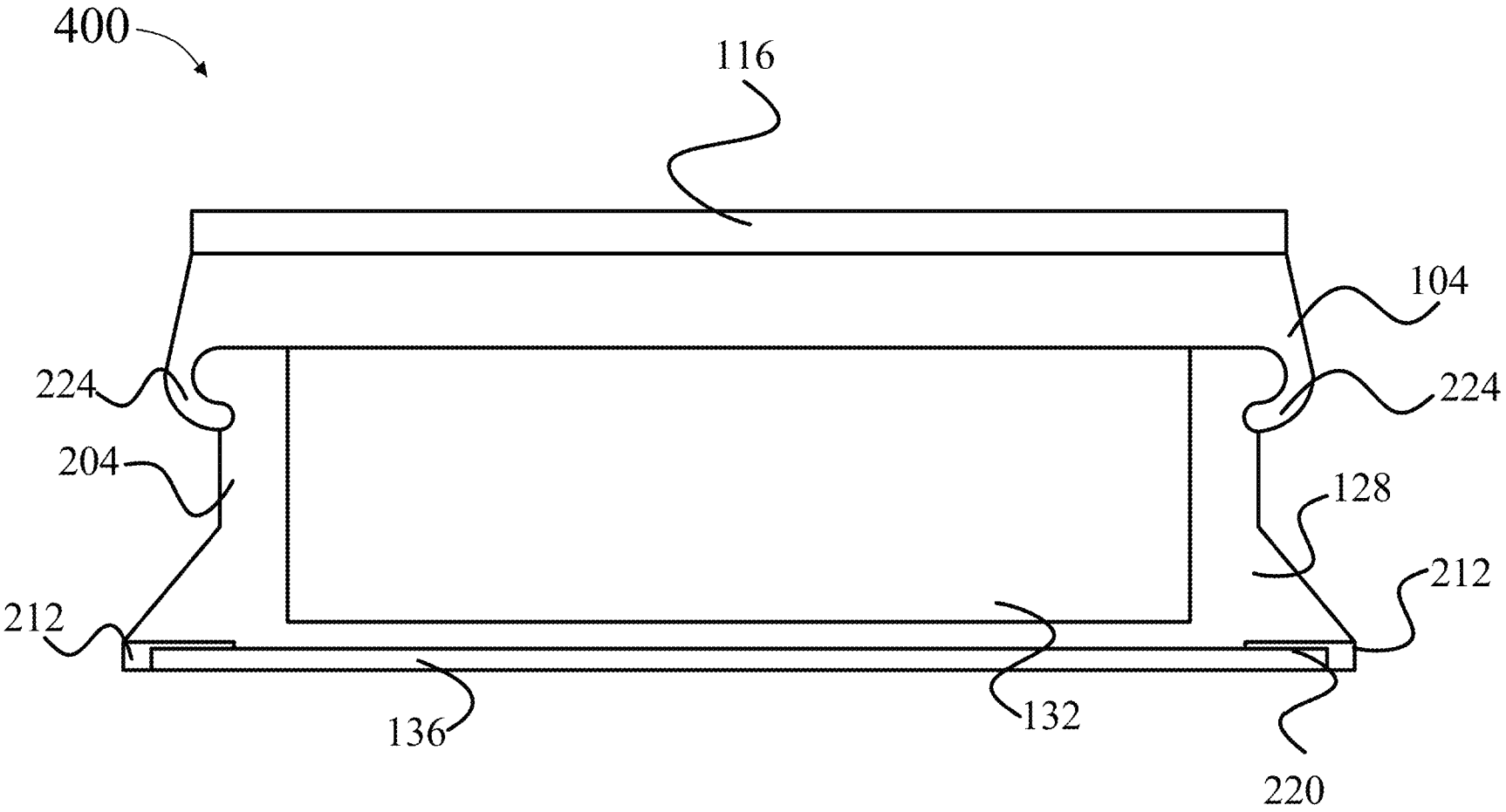
FIG. 4 illustrates another exemplary embodiment of the cross-sectional area view an of a snow and water sport sliding device with a pneumatic core.

Now referring to FIG. 4, another cross-sectional view of an exemplary embodiment 400 of device 100 for a snow and water sport sliding device with a pneumatic core is illustrated. Embodiment 400 of device 100 includes top layer 104, binding plate 116, component layer 128, air chamber 132, base layer 136, linear concave sidewall 204, and metal edge 212. In this embodiment, linear concave sidewall 204 is not attached to top layer 104 using a tubeless bead, but may be attached using any sort of adhesive, such as glue, paste, welding, or the like as long as they are rigidly attached to one another. Device 100 for a snow and water sport sliding device with a pneumatic core may be any of the embodiments shown herein and may include a tubeless bead or any other type of connection between the sidewalls and top layer 104. In some embodiments, embodiment 400 of device 100 may include a key component 220. In some embodiments, embodiment 400 of device 100 may include a rim 224 as described with reference to FIG. 2.

Figure 5:
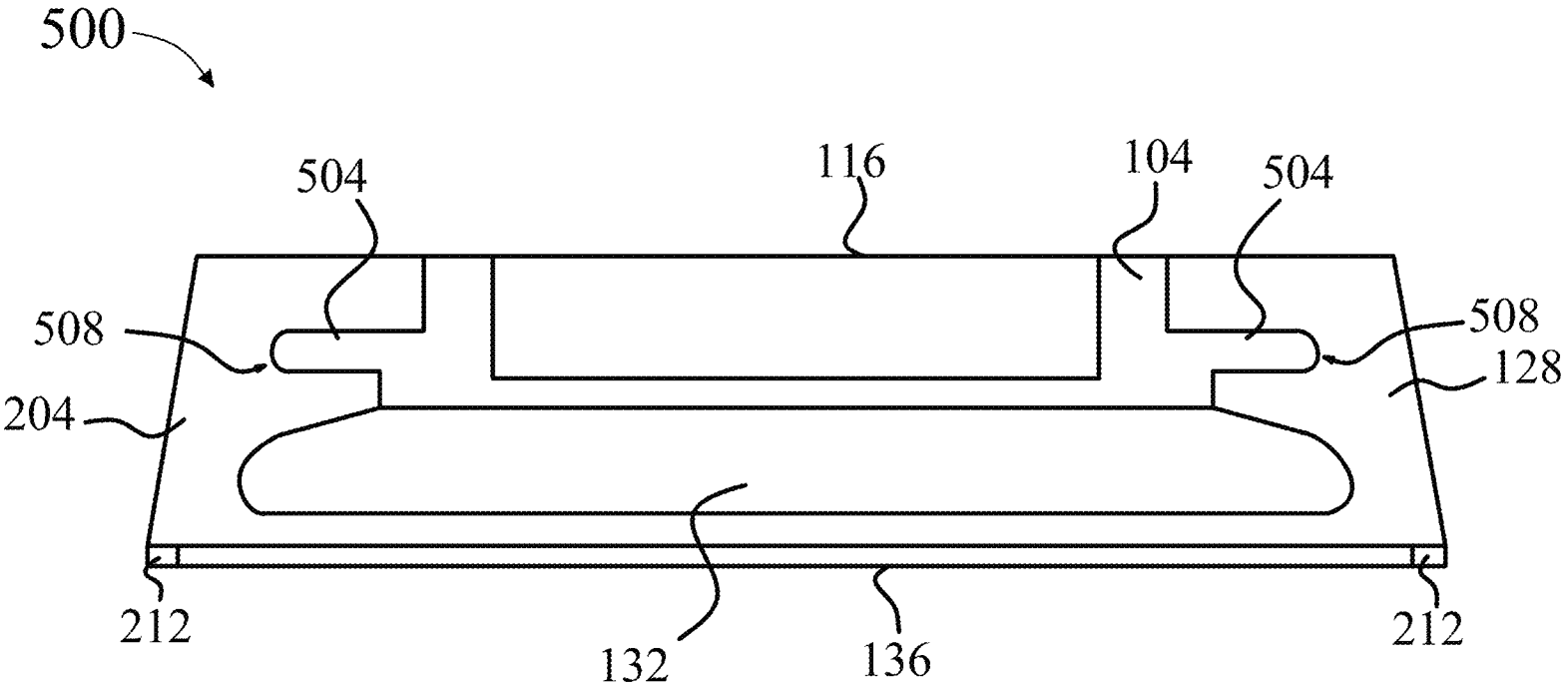
FIG. 5 is a diagram of a cross-sectional view of an exemplary embodiment of a device for a snow and water sport sliding device with a pneumatic core.

Referring now to FIG. 5, a cross-sectional view of an exemplary embodiment 500 of device 100 for a snow and water sport sliding device with a pneumatic core is illustrated. Embodiment 500 of device 100 may include a top layer 104, binding plate 116, main core component layer 128, air chamber 132, base layer 136, sidewall 204, and metal edge 212 as disclosed throughout this application. In some embodiments, embodiment 500 of device 100 may include a key component 220 (not shown.)

With continued reference to FIG. 5, embodiment 500 of device 100 may include one or more flanges 504. Flange 504 may be a component of or connected to top layer 104. In some embodiments, flange 504 may be configured to attach top layer 104 to sidewall 204. In some embodiments, flange 504 may comprise carbon fiber. In some embodiments, sidewalls 204 may define a receiving portion 508. Receiving portion 508 may be, as non-limiting example, a slot, depression, indentation, or the like, in sidewalls 204. In some embodiments, receiving portion 508 may be configured and arranged to receive flange 504. As a non-limiting example, flange 504 may be inserted into receiving portion 508; the interaction of flange 504 with receiving portion 508 may serve to attach top layer 104 with sidewall 204. In some embodiments, flange 504 may be bonded to sidewalls 204 so as to attach flange 504 to sidewalls 204.

Figure 6:
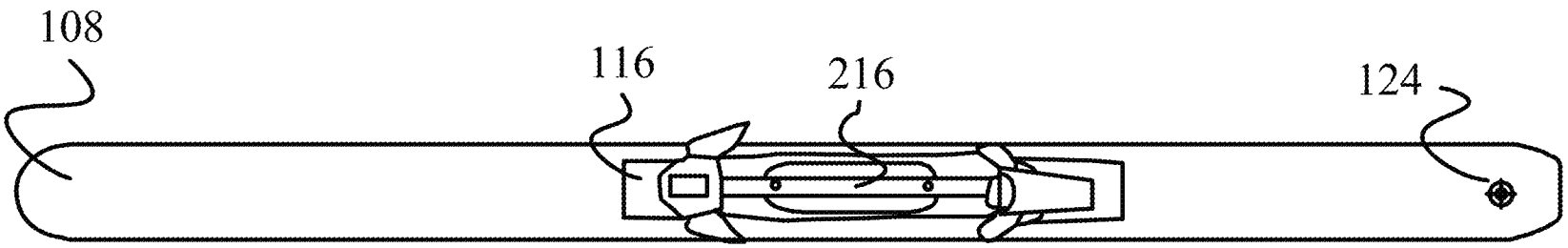
FIG. 6 is a top view of an exemplary embodiment of a snow and water sport sliding device with a pneumatic core.

Now referring to FIG. 6, a top view of an exemplary embodiment of a snow and water sport sliding device with a pneumatic core is shown. The figure exemplifies front tip and/or tail 108, binding plate 116, air valve 124, and binding 316.

Figure 7:
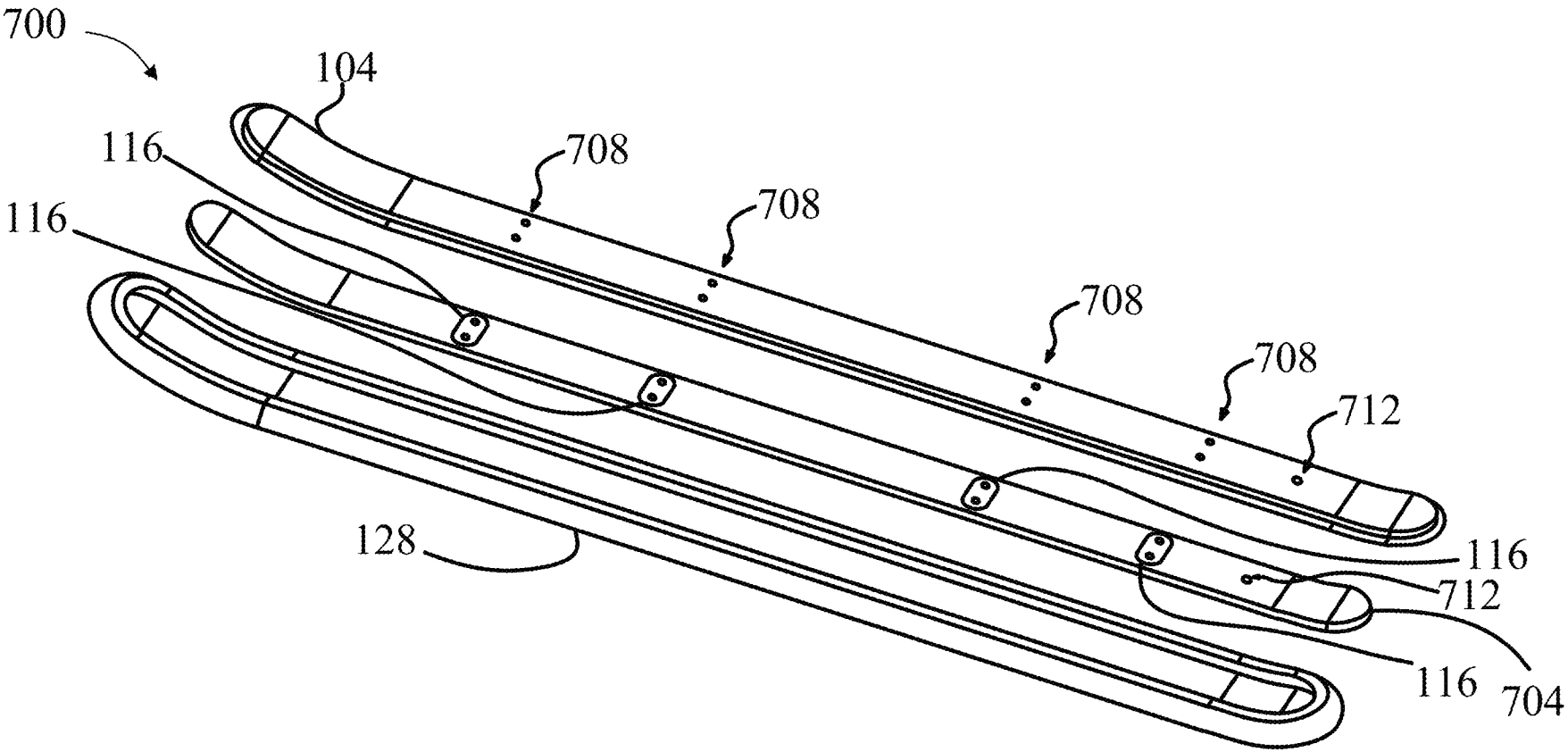
FIG. 7 is a partial exploded view of an exemplary embodiment of a snow and water sport sliding device with a pneumatic core.

Now referring to FIG. 7, an exemplary embodiment 700 of a snow and water sport sliding device with a pneumatic core is shown. Embodiment 700 may include a top layer 104, intermediate layer 704, and main core component layer 128. Intermediate layer 704 may be configured to fit into a cavity defined by top layer 104. Intermediate layer 704 may be attached to top layer using mechanical fasteners, adhesive, friction fit, and the like. Intermediate layer 704 may include a plurality of binding plates 116. Binding plates 116 may include one or more mounting features on to which bindings, as discussed above, may be mounted. In some embodiments, intermediate layer 704 may define a valve hole 712. Valve hole 712 may be configured to accept a portion of valve 124, so as to allow valve 124 to pass through intermediate layer 704. Top layer 104 may define a plurality of binding holes 708. Binding holes 708 may, in the assembled version of embodiment 700, be positioned over the mounting features of the binding plates 116. Binding holes 708 may be configured to accept one or more mechanical fasteners, such as screws, bolts, and the like, so as to allow a binding to attach to binding plates 116. Bindings are disclosed in greater detail above. In some embodiments, top layer 104 may define a valve hole 712. Valve hole 712 may be configured to accept a portion of valve 124, so as to allow valve 124 to pass through top layer 104.

Figure 8:
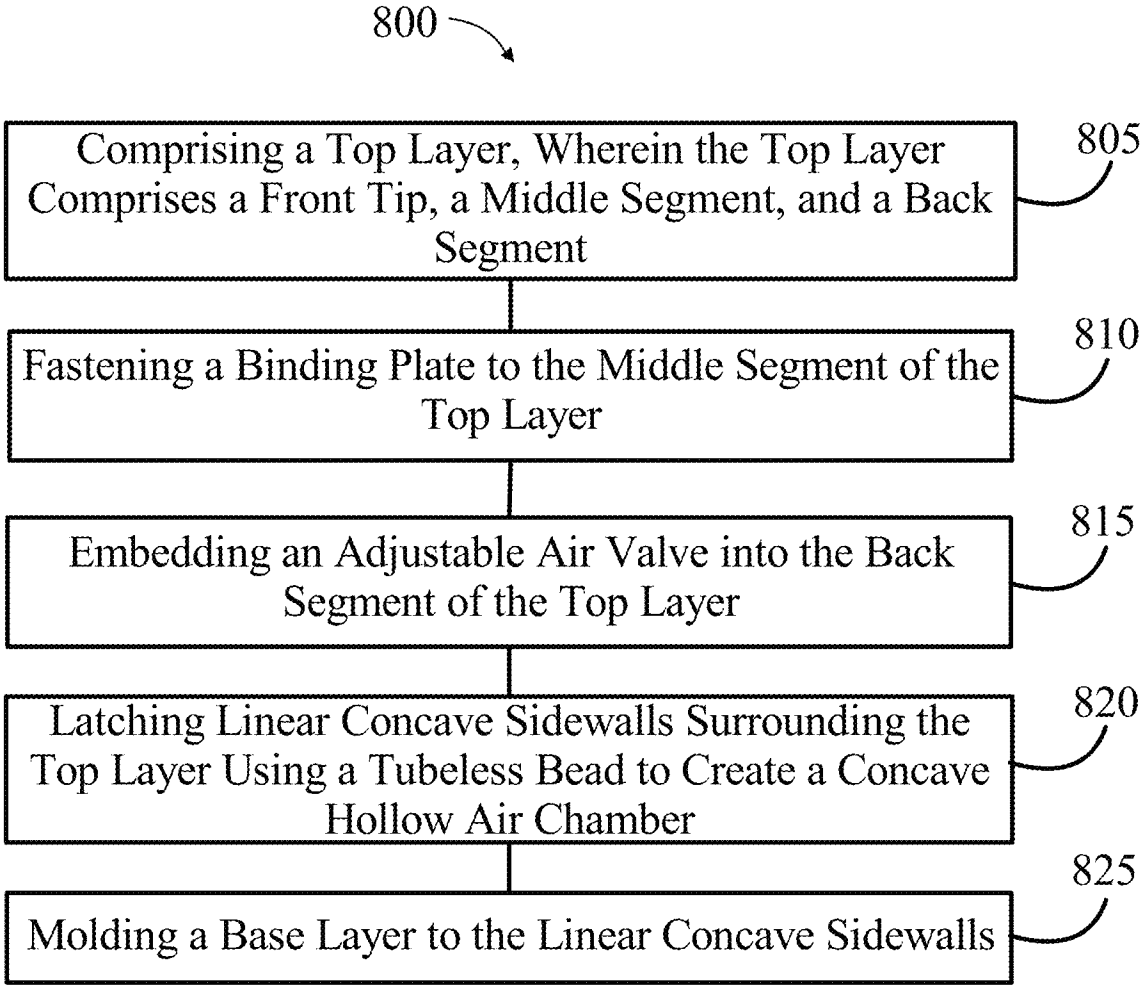
FIG. 8 is a flow diagram illustrating an exemplary embodiment of a method of manufacturing a snow and water sport sliding device with a pneumatic core.

Now referring to FIG. 8, a flow diagram illustrating an exemplary embodiment of a method 800 of manufacturing for a snow and water sport sliding device with a pneumatic core is illustrated. Pneumatic core may be any of the pneumatic cores described herein with reference to FIGS. 1A and 1B.

Still referring to FIG. 8, at step 805, method 800 includes providing a top layer, wherein the top layer includes a front tip, a middle segment, and a back segment. Top layer may include a composite spring blade system. Top layer may be composed of carbon fiber. Back segment of top layer may include a back tail. Back tail may be convex or concave. A tubeless bead may be latched into top layer. This step may be implemented as disclosed with respect to FIGS. 1-7.

Still referring to FIG. 8, at step 810, method 800 includes fastening a binding plate to a middle segment of top layer. Fastening binding plate to top layer may involve fastening screws into an aluminum layer of blinding plate. Binding plate may include an aluminum layer. This step may be implemented as disclosed with respect to FIGS. 1-7.

Still referring to FIG. 8, at step 815, method 800 includes embedding an adjustable air valve to a back segment of top layer. Adjustable air valve may be configured to allow air to pass in and out of hollow air chamber when in an open position. Adjustable air valve may be configured to not allow air to pass in and out of hollow air chamber when in a closed position. Adjustable air valve may include an air gauge. Adjustable air valve may be designed for CO2 cartridges and/or an air pump. This step may be implemented as disclosed with respect to FIGS. 1-7.

Still referring to FIG. 8, at step 820, method 800 includes latching linear concave sidewalls surrounding top layer using a tubeless bead to create a hollow air chamber. Main core component layer includes linear concave sidewalls. Linear concave sidewalls may be made from any material or combination of materials described above, including without limitation rubber. Hollow air chamber may be pressurized. This step may be implemented as disclosed with respect to FIGS. 1-7.

Still referring to FIG. 8, at step 825, method 800 includes molding a base layer to the linear concave sidewalls. Base layer may be made of hydrophobic material. Base layer may include embedded metal edges. Base layer may be composed of any material described above. Base layer may be wax absorbent. In some embodiments, method 800 may include attaching metal edges to the base layer. In some embodiments, this may be done using a keying component. In some embodiments, this may be done using an adhesive, such as glue, superglue, and the like. This step may be implemented as disclosed with respect to FIGS. 1-7.

Pneumatic ski technology embraces and addresses many variables involved in gliding down a water/snow surface effectively, efficiently, and competently; such variables may include a coefficient of dynamic friction, surface contact, friction, camber thrust, and viscoelasticity. In the traditional restricted linear flexure sandwich ski construction, the kinetic power or torque generated through rotational inertia invariably bottles up only to explode via the skier's ligaments and joints causing harm and injury to the user. As the pneumatic device leans out of the fall line, the kinetic power generated through rotational inertia will now be efficiently uncoiled and looped back to the pneumatic device through elastic deformation and other physics principles; the pneumatic ski and novel construction method makes much more efficient use of this energy.

A possibility of device having a rubber treadless base may allow for a low coefficient of friction. Also, a combination of air and rubber in conjunction with a user's push down a fall line may provide sufficient viscosity to conform to irregularities in terrain, thus maximizing surface contact. Additionally, blade spring, or the like, top layer may support camber thrust rebound and/or torsion spring properties. Moreover, a metal edge, embedded on either side of the multi-shaped but mostly rectangular rubber base, may enable friction on demand necessary for carving, braking and accelerating. "Siping" (straight edge, sawtooth cuts or serrated edge) may be applied to metal edges, which may add friction on demand by forcing each metal edge to conform in ways that enhance carving under hard cornering, such as without limitation traction on slick ice or snow. Pairing of metal edge with a rectangular pneumatic rubber component will allow the ski to conform to the undulating terrain such as snow terrain, minimizing stick slip and thus allowing consecutive singular arcs, leveraging a principal of mechanical keying. The pneumatic technology also allows for rebound, elastic deformation, and torque properties not allowable in the restricted traditional sandwich-layered ski construction due to the hollow air-filled chamber acting as a shock absorber; this causes the pneumatic technology to provide singular consecutive ski arcs and will keep the skier comfortably isolated from vibrations and/or heavy impacts when landing from any form of jumps thus a safer more controllable and fun product.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and software according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A snow sliding device, wherein the device comprises:

a top layer, the top layer comprising:

a front tip;

a plurality of rims wherein the plurality of rims is curved such that substantially vertical indentations are createdindentation is created;

a middle segment connected to the front tip, wherein the middle segment comprises a binding plate; and a back segment connected to the middle segment, wherein the back segment contains an adjustable air valve;

a main core component layer located beneath the top layer, wherein the main core component layer comprises a hollow air chamber and a plurality of linear concave sidewalls, and wherein the plurality of linear concave sidewalls fit into the substantially vertical indentations; and a base layer.

2. The snow sliding device of claim 1, wherein the top layer further comprises a composite spring blade system.

3. The snow device of claim 1, wherein the top layer comprises carbon fiber.

4. The snow device of claim 1, wherein the binding plate comprises an aluminum layer.

5. The snow sliding device of claim 1, wherein the base layer comprises a hydrophobic material.

6. The snow sliding device of claim 1, wherein the base layer comprises a plurality of embedded metal edges.

7. The snow sliding device of claim 1, wherein the base layer comprises an elastic material.

8. The snow sliding device of claim 1, wherein the base layer is wax absorbent.

9. The snow sliding device of claim 1, wherein the linear concave sidewalls comprise rubber.

10. The snow sliding device of claim 1, wherein the hollow air chamber is pressurized.

11. The snow sliding device of claim 1, wherein the back segment further comprises a back tail.

12. The snow sliding device of claim 11, wherein the back tail is convex.

13. The snow sliding device of claim 1, wherein the linear concave sidewalls comprise a tubeless bead, wherein the tubeless bead is latched into the top layer.

14. The snow sliding device of claim 1, wherein the adjustable air valve is configured to allow air to pass in and out of the hollow air chamber when the adjustable air valve is in an open position.

15. The snow sliding device of claim 1, wherein the adjustable air valve includes an air gauge.

16. The snow sliding device of claim 1, wherein the adjustable air valve is configured to be attached to an air pump.

* * * * *